US006622611B2

(12) United States Patent
Nesi

(10) Patent No.: US 6,622,611 B2
(45) Date of Patent: Sep. 23, 2003

(54) HYDRAULIC DEVICE

(75) Inventor: Fernando Nesi, Brussels (BE)

(73) Assignee: Baka, Gembloux (BE)

( * ) Notice: Subject to any disclaimer, the term of this patent is extended or adjusted under 35 U.S.C. 154(b) by 122 days.

(21) Appl. No.: 09/910,868

(22) Filed: Jul. 24, 2001

(65) Prior Publication Data

US 2002/0026870 A1 Mar. 7, 2002

(30) Foreign Application Priority Data

Jul. 26, 2000 (EP) ..... 00870170

(51) Int. Cl.[7] ..... F15B 11/00
(52) U.S. Cl. ..... 91/536; 91/526; 60/484
(58) Field of Search ..... 91/6.5, 526, 536; 60/471, 484

(56) References Cited

U.S. PATENT DOCUMENTS 3,408,901 A 11/1968 Inhofer 4,039,010 A 8/1977 Tucek

FOREIGN PATENT DOCUMENTS

FR 2578003 2/1985

*Primary Examiner*—Edward K. Look
*Assistant Examiner*—Michael S Leslie
(74) *Attorney, Agent, or Firm*—Sughrue Mion, PLLC

(57) ABSTRACT

A hydraulic device having two hydraulic actuators, in particular a motor and a double-acting jack, each having two couplings for the entry and/or the exit of a control fluid. Two pipes are coupled to the two actuators and designed so that one conveys a pressurized fluid to a respective coupling of each actuator while the other discharges the fluid to the other respective coupling, and vice versa, in such a way that the jack can be controlled to selectively produce a movement in opposite directions. A selective reversing gate reverses, between the two pipes, the supplying of pressurized fluid and the discharging of the fluid so as to control the direction of the movement of the jack.

8 Claims, 6 Drawing Sheets

HYDRAULIC DEVICE

BACKGROUND OF THE INVENTION

The present invention relates to a hydraulic device comprising two hydraulic actuators, in particular a motor and a double-acting jack, each comprising two couplings for the entry and/or the exit of a control fluid. Two pipes are coupled to the two actuators and devised so that one conveys a pressurized fluid to a respective coupling of each actuator whilst the other discharges the fluid to the other respective coupling, and vice versa, in such a way that one of the actuators, in particular the jack, can be controlled so as to selectively produce a movement in one direction as well as in a reverse direction. A selective reversing gate is provided for reversing between the two pipes the supplying of pressurized fluid and the discharging of the fluid, so as to control the direction of the movement of one of the actuators, in particular of the said jack.

A device of the kind can consist of a rig intended in particular for agricultural, civil engineering or military works, in which the reversing gate is a control available to an operator of the rig, for example by way of a lever or of a pedal. In this kind of rig, two pipes are often installed in reserve mode to control an optional accessory which may be mounted at the tip of an articulated arm.

An exemplary case of such an optional accessory is a coring or drilling apparatus which is equipped with a hydraulic motor for rotating a drill bit and with a double-acting hydraulic jack or with another hydraulic motor for imparting to the bit a drilling advancing movement and a retreating movement of the bit.

In this exemplary case, given that only two pipes are available for the accessory, the jack and the motor must be coupled in parallel to them in such a way that, while powering the jack for an advancing movement of the bit, the motor rotates in a drilling direction. Consequently and automatically, upon powering the jack in a direction of retreat of the bit, the motor is caused to rotate in the direction reverse to the drilling direction and this is especially undesirable. The aim of the present invention is to remedy in particular this problem and to provide in this case, as in others not described at present, a simple and effective means which makes it possible, on the one hand, to procure in a known manner the advancing and retreating movement of the jack and, on the other hand, to have the motor of the bit retain the same direction of rotation during both the advancing and retreating movements, without adding further pipe (s) to an existing rig.

SUMMARY OF THE INVENTION

Accordingly, the invention consists in equipping the device, at the location of the aforesaid accessory, with a means of detection sensitive to a difference in pressure between the pressurized fluid and the discharged fluid, and placing between the abovementioned reversing gate and the other actuator for which one wishes the fluid to always act in the same direction, in particular the hydraulic motor, an auxiliary reversing means, devised so as to receive a command from the detection means and to automatically couple, as a function of this command, the pipe supplied with pressurized fluid to a same specified coupling of the other actuator, in particular the motor.

In one embodiment of the device according to the invention, the detection means and auxiliary reversing means are combined into a system of four check valves each devised so as to open in one direction and close in the other direction of flow of the fluid. These four valves are then mounted in the manner of a four-diode Graëtz bridge for rectifying an electric current, as explained in detail hereinbelow.

In another embodiment of the invention, the device concerned can comprise, in the guise of detection means, at least one drive gate devised so as to sense the pressure of the pressurized fluid, with respect to that of the discharged fluid, of one of the two pipes, and in the guise of auxiliary reversing means, a gate having two positions, a position for parallel coupling and a position for crossed coupling of the two pipes to the two couplings of the second actuator.

Other details and features of the invention will emerge from the secondary claims and from the description of the drawings which are appended to the present document and which illustrate, by way of nonlimiting examples, particular embodiments of the device according to the invention.

DETAILED DESCRIPTION OF THE INVENTION

Figure 1:
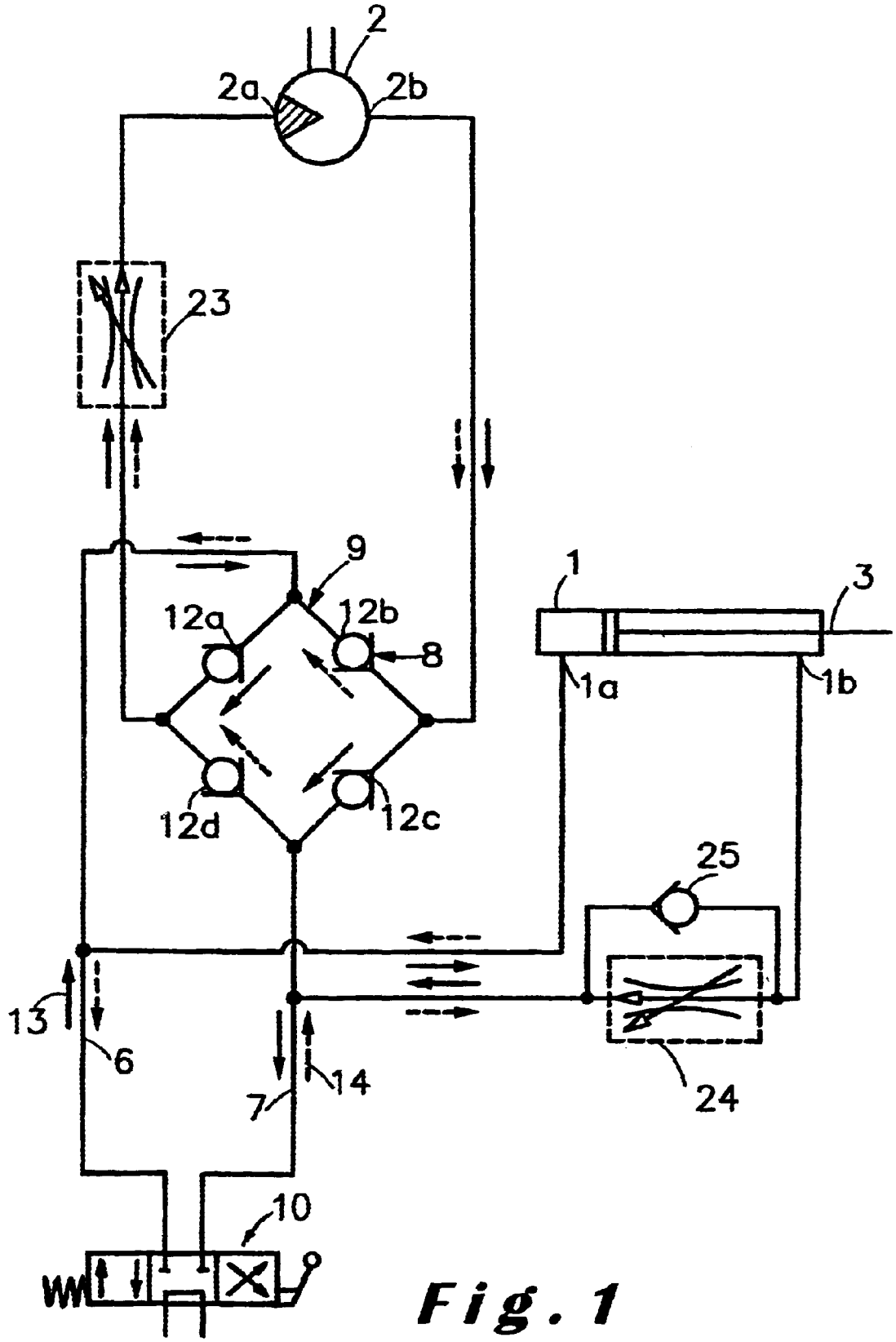
FIG. 1 shows a simplified hydraulic diagram of a first way of connecting up the two actuators and the detection means and auxiliary reversing means of the device according to the invention.

In the various figures, the same reference notation designates identical or similar elements.

The hydraulic device to which the invention relates can comprise (FIG. 1) at least two hydraulic actuators 1 and 2 each usually comprising two couplings, respectively 1*a* and 1*b* for the one and 2*a* and 2*b* for the other, for the entry and/or the exit of a control fluid. The actuator 1 can be a double-acting jack 1, the direction of displacement of whose stem 3 must be capable of being reversed, whereas the actuator 2 can be an abovementioned hydraulic motor 2 or, as appropriate, for example a single-acting jack (not represented) whose stem must constantly provide a thrust in the same direction.

Two pipes 6 and 7 are coupled to the two actuators 1 and 2 and are devised so that one conveys a pressurized fluid to a respective coupling of each actuator whilst the other discharges the fluid to the other respective coupling, and vice versa, in such a way that one of the actuators, in particular the jack 1, can be controlled so as to selectively produce a movement in one direction as well as in a reverse direction. A selective reversing gate 10 is provided for reversing upstream, between the two pipes 6 and 7, the supplying of pressurized fluid and the discharging of the fluid, so as to control the direction of the movement of the said jack 1.

To achieve the sought-after aim explained hereinabove, the device of the invention comprises at least one means of detection 8 sensitive to a difference in pressure between the pressurized fluid and the discharged fluid, and between the aforesaid reversing gate and the other actuator 2, in this instance the motor 2, an auxiliary reversing means 9, devised so as to receive a command from the detection means 8 and to automatically couple, as a function of this command, the pipe 6, 7 supplied at this moment with pressurized fluid to one and the same specified coupling 2*a* of the motor 2.

As already stated hereinabove, the detection means 8 and auxiliary reversing means 9 (FIG. 1) may advantageously be combined into a system of four check valves 12 devised so as to open in one direction and close in the other direction of flow of the fluid.

These known valves 12, shown diagrammatically in FIG. 1, can each consist, as is known to the person skilled in the art, of a body which has an entrance orifice and an exit orifice for the hydraulic fluid and in which are placed a ball forming the valve proper and a spring positioning the ball against a valve seat.

In this system, a first valve 12*a* and a second valve 12*b* are coupled by one of their orifices to a first of the two pipes, for example the pipe 6: the first valve 12*a* in a passing direction and the second 12*b* in a blocking direction for the fluid coming from this first pipe 6. A third valve 12*c* and a fourth valve 12*d* are coupled by one of their orifices to the second pipe 7: the third valve 12*c* in a blocking direction and the fourth valve 12*d* in a passing direction for the fluid coming from the second pipe 7.

The first and fourth valves 12*a*, 12*d* are then coupled by their other respective orifice to a chosen coupling, for example the coupling 2*a*, of the second actuator or hydraulic motor 2. The second and third valves 12*c*, 12*d* are also coupled by their other respective orifice to the other coupling 2*b* of the second actuator 2.

The person skilled in the art can follow in FIG. 1 the manner of operation of the system of valves 12. Arriving from the reversing gate controlled for example by the operator of the device, the pressurized fluid flows, following the solid arrow 13, through the pipe 6. It thus goes off not only towards the coupling 1*a* of the jack 1, in order to take the stem 3 out, but also towards the system of valves 12. The valve 12*b* blocks the passage whilst the valve 12*a* allows the pressurized fluid to reach the coupling 2*a*, of the motor 2, corresponding to a drilling direction of rotation for the bit of the exemplary case mentioned above. The valve 12*d* prevents the pressurized fluid from escaping to the pipe 7 which serves as return pipe. The fluid which leaves the motor 2 via its coupling 2*b* arrives at the fork of the valve 12*b*, jammed closed by the pressurized fluid coming from the pipe 6, and of the valve 12*c* which allows it to escape to the pipe 7 in the guise of discharged fluid.

Following the reversing of the reversing gate by the operator, the pressurized fluid arrives via the pipe 7, following the broken arrow 14. It then goes off towards the coupling 1*b* of the jack 1 so as to bring the stem 3 back in. At the same time it arrives at the fork towards the valve 12*c* which blocks its passage and at the valve 12*d* which allows its passage to the coupling 2*a* of the motor 2, corresponding to the drilling direction of rotation. The valve 12*a* prevents the pressurized fluid escaping to the pipe 6 which serves as return pipe. The fluid which leaves the motor 2 via the coupling 2*b* arrives at the fork of the valve 12*c*, jammed closed by the pressurized fluid coming from the pipe 7, and of the valve 12*b* which allows it to escape to the pipe 6 in the guise of discharged fluid. This demonstrates that the sought-after aim is achieved.

Figure 2:
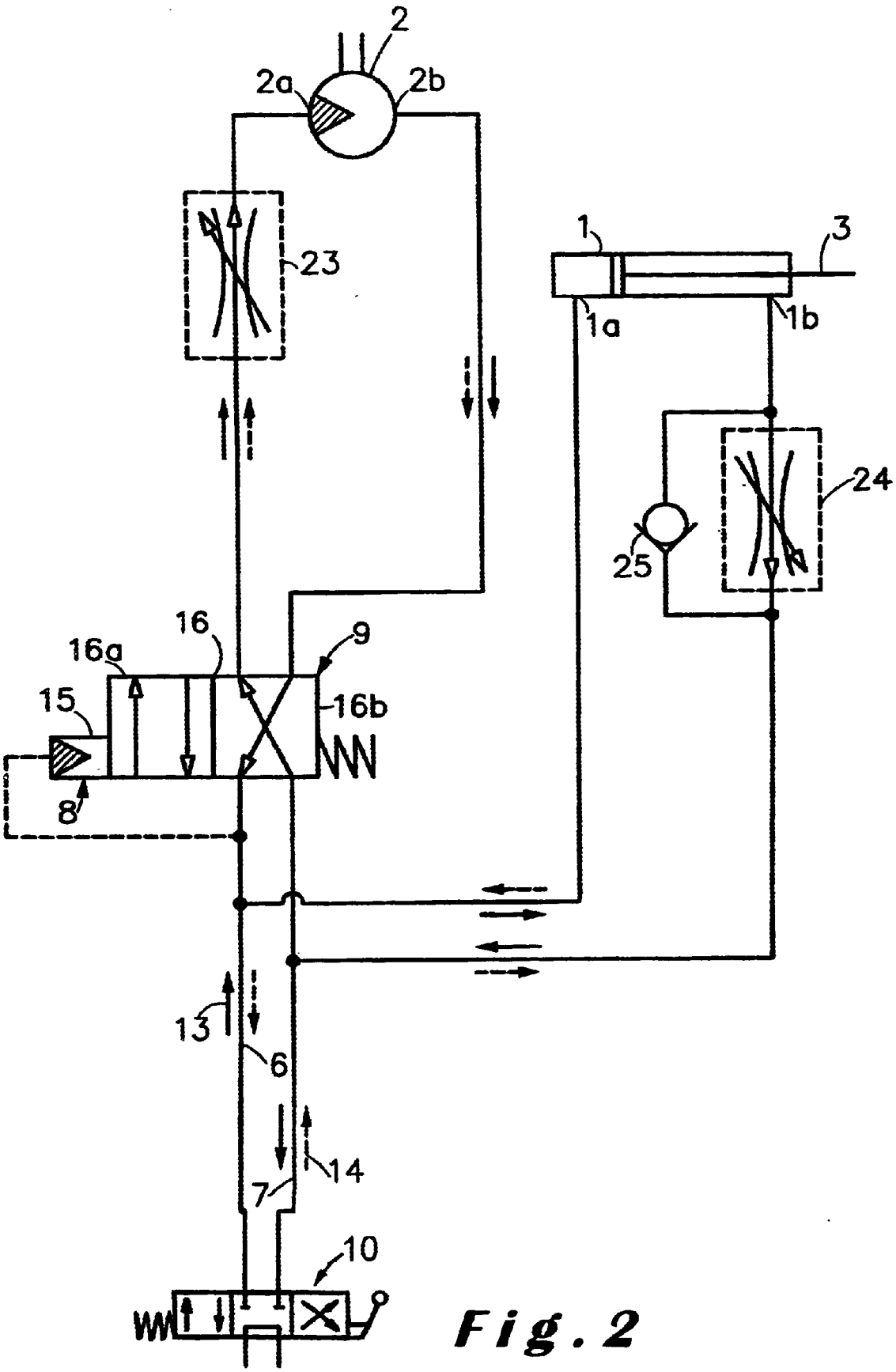
FIGS. 2 to 6 show in the same manner various possible alternative ways of connecting up the two actuators and the detection means and auxiliary reversing means of the device according to the invention.

In another embodiment of the invention (FIG. 2), the device can comprise, as detection means 8 for sensing the pressure of the pressurized fluid with respect to that of the discharged fluid, at least one drive gate 15 connected up to one of the two pipes, for example the pipe 6 according to the drawing. The auxiliary reversing means can then be a gate 16 having two positions, a position for parallel coupling and a position for crossed coupling of the two pipes 6, 7 to the two couplings 2*a* and 2*b* of the motor 2. The symbols of the gate 16 which are represented in the drawings explain its type.

When the drive gate 15 detects in the pipe 6 the pressure of the pressurized fluid greater than that of the discharged fluid, it operates the auxiliary reversing gate 16 so that the latter connects up (position 16*a*), on the one hand, the pipe 6 and the coupling 2*a* and, on the other hand, the coupling 2*b* and the pipe 7 which then serves for discharge. When the drive gate 15 detects in the pipe 6 the pressure of the discharged fluid less than that of the pressurized fluid, it operates the auxiliary reversing gate 16 so that the latter connects up (position 16*b*), on the one hand, the pipe 7 and the coupling 2*a* and, on the other hand, the coupling 2*b* and the pipe 6 which then serves for discharge.

Figure 3:
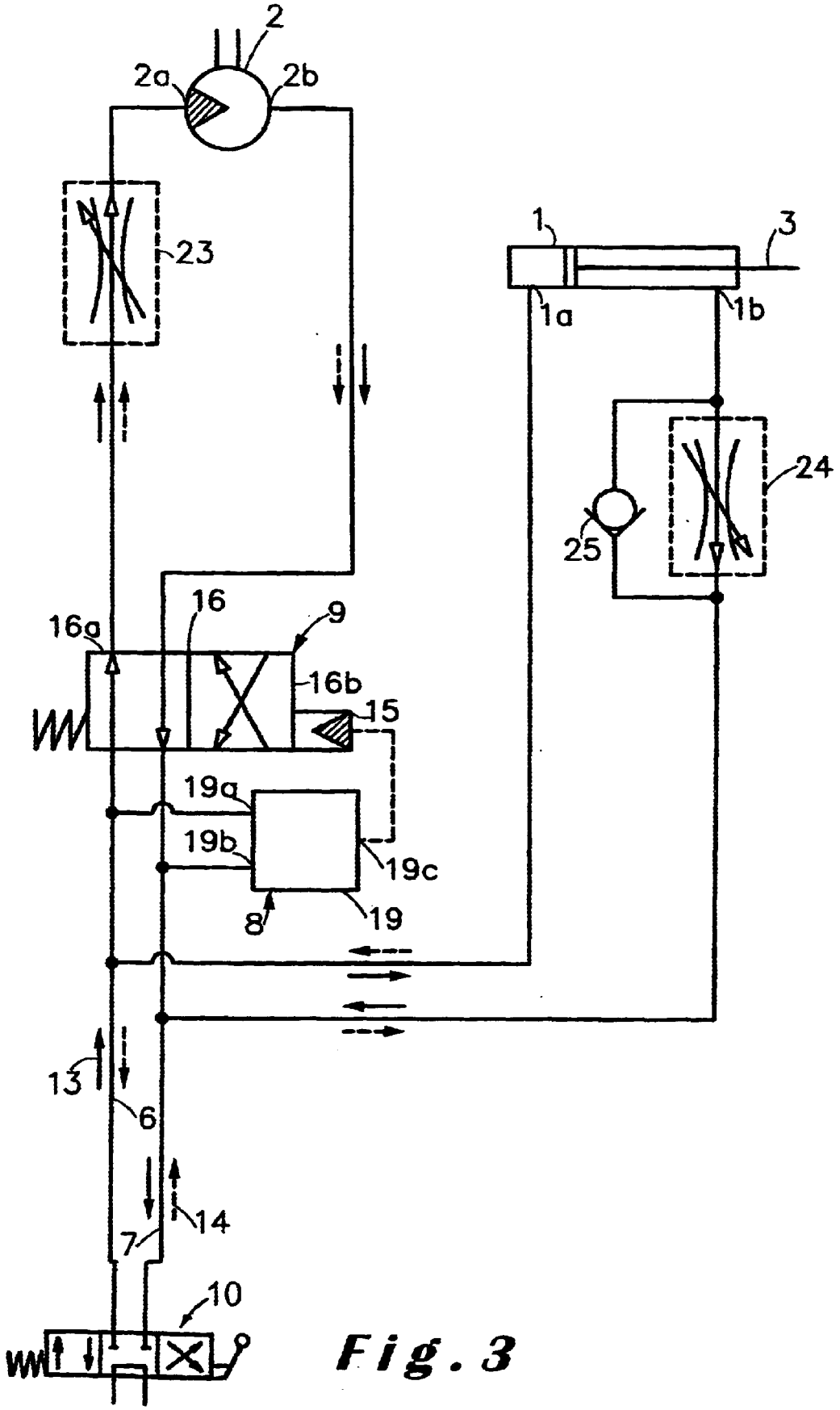

In an alternative embodiment of the invention, the detection means 8 can be (FIG. 3) a pressure comparator 19 having two inputs 19*a* and 19*b* for a respective pressure signal and a control output 19*c*, the input 19*a* being coupled to the pipe 6 and the input 19*b* to the pipe 7 so as to sense the respective pressures thereof. The control output 19*c* is coupled, optionally by way of a drive gate, to a two-position gate 16 similar to that just described, to obtain a manner of operation of the same kind.

Figure 4:
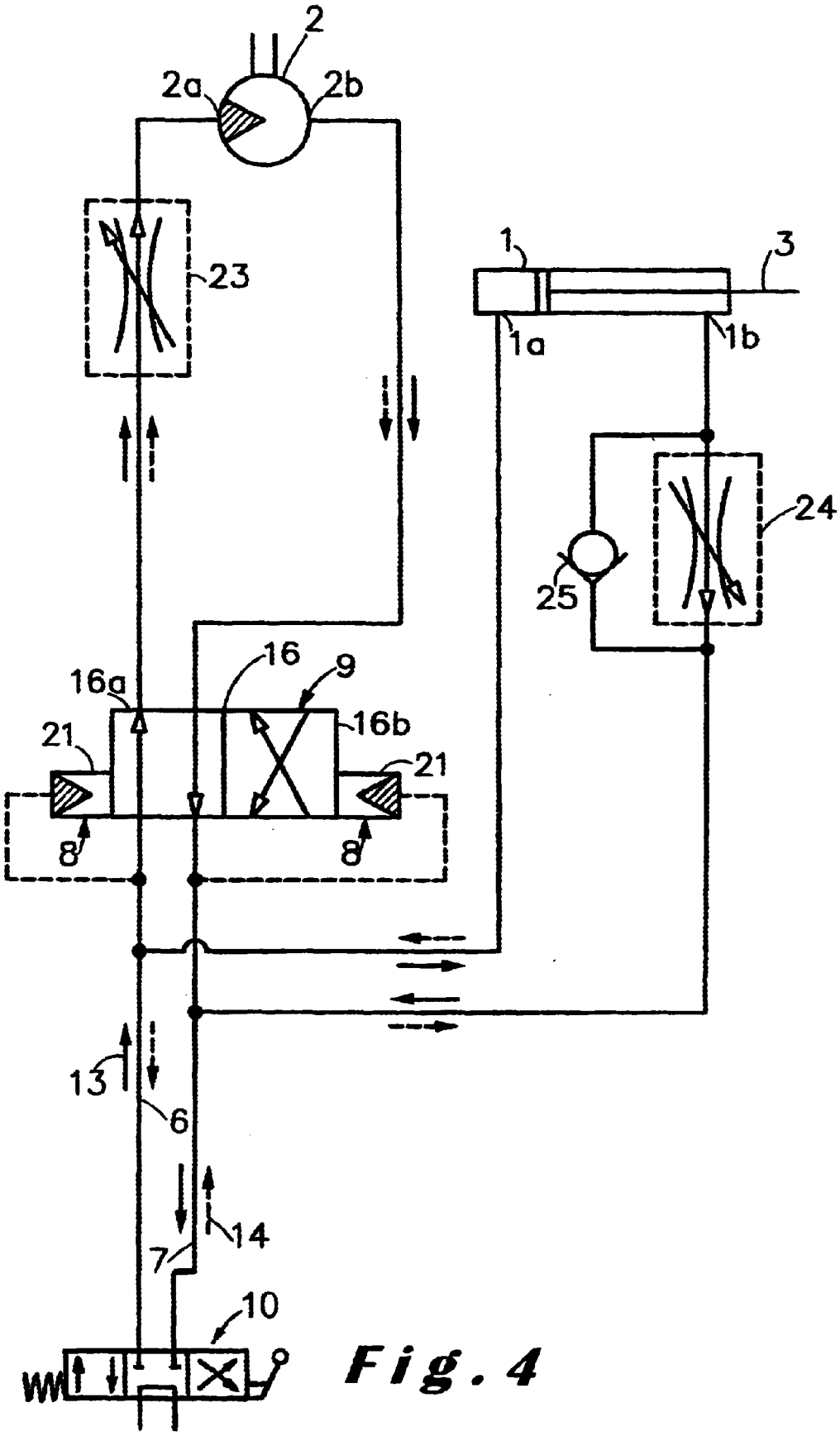
Figure 6:
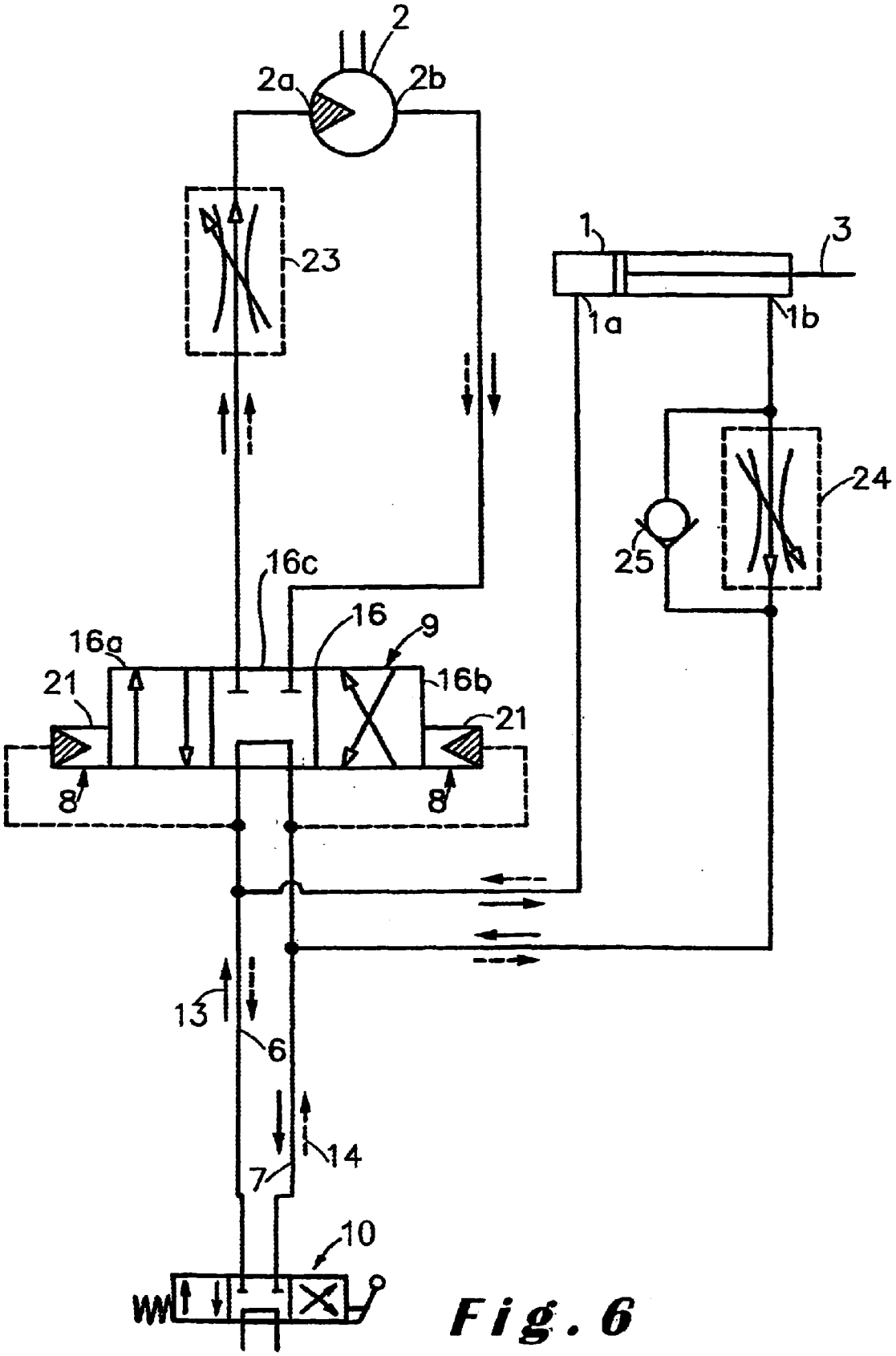

In another alternative embodiment of the invention, the detection means 8 or pressure comparator can be (FIG. 4) formed by two drive gates 21 devised so that each senses the pressure of a respective pipe 6 or 7 of the two aforesaid pipes. The drive gates 21 can operate, also in this case, a two-position gate 16 described hereinabove. However, in this alternative embodiment one could prefer a three-position gate (FIG. 6) comprising a third position 16*c* in which, when the two drive gates 21 sense a pressure of the same order in their associated pipe, the passage of fluid between the two pipes 6, 7 and the second actuator 2 is blocked so as to preclude any possible abnormal operation of the device.

It should be understood that the invention is in no way limited to the embodiments described and that many modifications may be made to them without departing from the scope of the claims.

Figure 5:
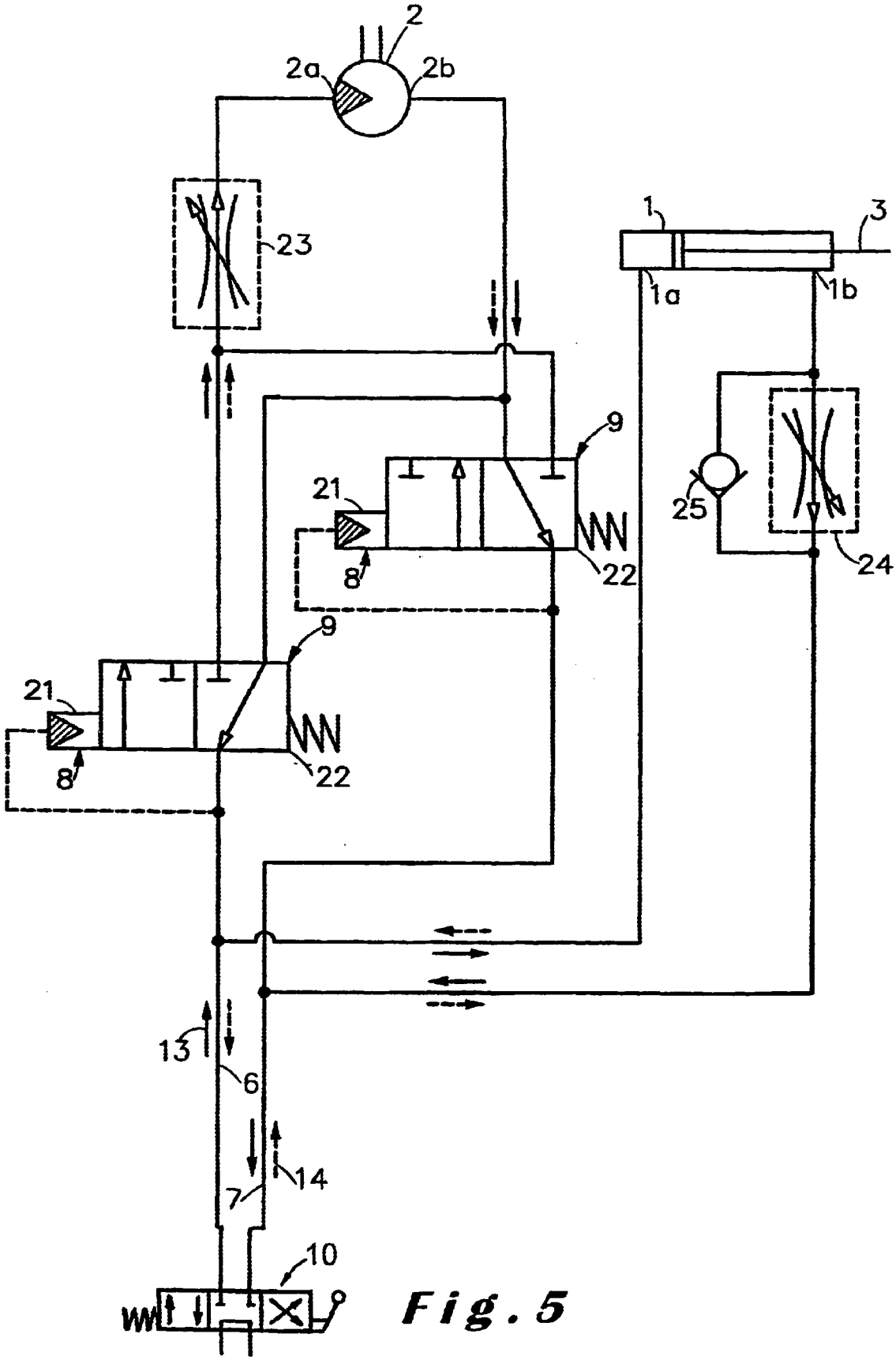

Thus, FIG. 5 represents a nonexhaustive further alternative embodiment of the detection means 8 and auxiliary reversing means 9. The reversing means 9 are constituted therein by two separate gates 22 with two positions, a gate 22 for each pipe 6, 7. Each gate 22 is controlled by an associated drive gate 21 connected up so as to detect in the corresponding pipe 6, 7 the presence of the pressurized fluid or of the discharged fluid and so as to set the appropriate position of the associated gate 22 accordingly. In the setup of FIG. 5, it is apparent that each gate 22 (whose symbols explain the type) supplies, alternately with the other, the motor 2 or alternately allows the discharging of the fluid thereof.

The device of the invention can comprise, in a known manner and with a usual aim, a flow rate regulator 23 placed upstream of the coupling 2*a* for supplying the motor 2 so as to limit the speed of the latter and to produce an appropriate back pressure so that the jack 1 constantly receives an adequate control pressure in respect of its reciprocating translational movements.

Another flow rate regulator 24 associated in a known manner with a check valve 25 can advantageously be placed upstream of the coupling 1*b* of the jack 1 (on the stem side) so as to set the speed of displacement of the stem 3 during drilling.

From the foregoing explanations it is clearly apparent that, with the two pipes 6, 7, two distinct functions and movements, namely a rotation in a single direction for the actuator 2 and a reciprocating movement for the actuator 1, are provided for without requiring a hydraulic, pneumatic or electrical auxiliary control source. It is sufficient for the flow rate of hydraulic fluid to be greater than the aggregate flow rates necessary for supplying the two actuators.

It should also be understood within the scope of the claims that two or more actuators 1 may be connected up in parallel, as can two or more actuators 2, in the circuit of any of the figures.

Key for the Figures

1 Actuator, hydraulic motor
1*a*, 1*b* Couplings of 1
2 Actuator, double-acting jack
2*a*, 2*b* Couplings of 2
3 Stem of 2
6 Pipe
7 Pipe
8 Detection means
9 Reversing means
12 Valves 12*a* to 12*d*
13 Solid arrows
14 Broken arrows
15 Drive gate
16 Two-position gate
16*a* "Parallel" position of 16
16*b* "Crossed" position of 16
19 Pressure comparator
19*a* Input of 19
19*b* Input of 19
19*c* Output of 19
21 Drive gate
22 Two-position gate
23 Flow rate regulator
24 Flow rate regulator
25 Check valve

What is claimed is:

1. A hydraulic device comprising, two hydraulic actuators (1, 2), each comprising two couplings (1*a*, 1*b*, 2*a*, 2*b*) for entry and/or exit of a control fluid, only two pipes (6, 7) coupled to the two actuators (1, 2) and designed so that one of the two pipes supplies a pressurized fluid to a respective coupling of each actuator whilst the other of the two pipes discharges the fluid to the other respective coupling, and vice versa, in such a way that one (1) of the two actuators, is controlled so as to selectively produce a movement in one direction as well as in a reverse direction, and a selective reversing gate for reversing, between the two pipes (6, 7), the supplying of pressurized fluid and the discharging of the fluid, so as to control the direction of the movement of said one actuator (1), the device being characterized in that it comprises:

means (8) for detecting a difference in pressure, between the pressurized fluid and the discharged fluid, and for transmitting a corresponding command, and between the reversing gate and the other (2) of said two actuators, auxiliary reversing means (9), for receiving said command from the detecting means (8) and for automatically coupling, as a function of said command, the one of said two pipes (6, 7), which is supplied with the pressurized fluid, to said respective coupling (2*a*) of said other actuator (2).

2. The device according to claim 1, characterized in that the detection means (8) and auxiliary reversing means (9) are combined into a system of four check valves (12) having orifices and designed so as to open in one direction, and close in the other direction, of flow of the fluid, a first (12*a*) and a second (12*b*) of the valves being coupled by one of their said orifices to a first (6) of the two pipes (6, 7), the first valve (12*a*) being coupled in a passing direction, and the second valve (12*b*) being coupled in a blocking direction for the fluid coming from the first pipe (6), a third (12*c*) and a fourth (12*d*) of the valves being coupled by one of their said orifices to the second pipe (7), the third valve (12*c*) being coupled in a blocking direction, and the fourth valve (12*d*) being coupled in a passing direction for the fluid coming from the second pipe (7), the first (12*a*) and the fourth (12*d*) valves being coupled by their other said orifices to a chosen coupling (2*a*) of the second actuator (2), and the second (12*b*) and the third valve (12*c*) being coupled by their other said orifices to the other coupling (2*b*) of the other actuator (2).

3. The device according to claim 1, characterized in that, said detecting means (8) comprises at least one drive gate (15) which senses the pressure of the pressurized fluid, with respect to that of the discharged fluid, of one of the two pipes (6, 7), and said auxiliary reversing means (9) comprises a gate (16) having two positions: a position (16*a*) for parallel coupling, and a position (16*b*) for crossed coupling, of the two pipes (6, 7) to the two couplings (2*a*, 2*b*) of the other actuator (2).

4. The device according to claim 1, characterized in that, said detecting means (8) comprises a pressure comparator (19) with two inputs (19*a*, 19*b*) for a respective pressure signal and with a control output (19*c*), one input (19*a*) being coupled to the one pipe (6) and the other input (19*b*) to the other pipe (7), and said auxiliary reversing means (9) comprises a gate (16) having two positions, a position (16*a*) for parallel coupling, and a position (16*b*) for crossed coupling, of the two pipes (6, 7) to the two couplings (2*a*, 2*b*) for the fluid of the other actuator (2), the output (19*c*) of the comparator (19) being coupled to the gate (16) so as to control the gate (16).

5. The device according to claim 1, characterized in that, said detecting means (8) comprises two drive gates (21) designed so that each senses the pressure of a respective pipe (6, 7) of the two pipes, and said auxiliary reversing means (9) comprises a gate (16) having at least two positions, a position (16*a*) for parallel coupling, and a position (16*b*) for crossed coupling, of the two pipes (6, 7) to the two couplings (2*a*, 2*b*) of the other actuator (2).

6. The device according to claim 5, characterized in that said auxiliary reversing means (9) further comprises a gate comprising a third position in which, when the two drive gates (21) sense a pressure of the same order in their associated pipe of said two pipes (6, 7), the passage of fluid between the two pipes (6, 7) and the other actuator (2) is blocked.

7. The device according to any one of claims 1 to 6, characterized in that it comprises a rig intended for agricultural, civil engineering or military works, the reversing gate is a control available to an operator of the rig, and the two actuators (1, 2) are located remotely, at a tip of an articulated arm, the two pipes (6, 7) being installed in reserve mode for controlling an optional accessory which may be mounted at the tip of said arm.

8. The device according to any one of claims 1 to 6, wherein said two actuators are a motor (2) and a double-acting jack (1), respectively.

* * * * *